United States Patent [19]

Hansberry

[11] Patent Number: 5,065,684

[45] Date of Patent: Nov. 19, 1991

[54] LIMP MATERIAL SEGMENT TRANSPORT APPARATUS FOR SEWING MACHINES

[75] Inventor: Mitchell L. Hansberry, Framingham, Mass.

[73] Assignee: The Charles Stark Draper Laboratory, Inc., Cambridge, Mass.

[21] Appl. No.: 523,666

[22] Filed: May 15, 1990

[51] Int. Cl.[5] ..... D05B 21/00; D05B 27/00

[52] U.S. Cl. ..... 112/311; 112/121.12; 112/320; 901/16; 901/23; 901/30; 271/264

[58] Field of Search ..... 112/311, 320, 121.12, 112/121.15, 153, 306, 303, 2, 1; 414/14, 17; 901/15, 16, 17, 18, 19, 23, 27, 30, 6

[56] References Cited

U.S. PATENT DOCUMENTS

| | | | |
|---|---|---|---|
| 4,103,884 | 8/1978 | Kawashima | 271/18.3 |
| 4,252,360 | 2/1981 | Gallaher, Jr. | 901/23 X |
| 4,425,858 | 1/1984 | Hargett | 112/121.12 |
| 4,457,243 | 7/1984 | Bowditch | 112/121.14 |
| 4,512,269 | 4/1985 | Bowditch | 112/121.12 |
| 4,601,463 | 7/1986 | Goto et al. | 271/18.3 X |
| 4,607,584 | 8/1986 | Bowditch | 112/147 |
| 4,632,046 | 12/1986 | Barrett et al. | 112/121.14 |
| 4,719,864 | 1/1988 | Barrett et al. | 112/121.12 |
| 4,776,579 | 10/1988 | Romand et al. | 901/16 X |
| 4,932,343 | 6/1990 | Mardix et al. | 112/121.12 |

*Primary Examiner*—Peter Nerbun

*Attorney, Agent, or Firm*—Lahive & Cockfield

[57] ABSTRACT

The invention is an apparatus for transporting a limp material segment, such as cloth, along a reference axis parallel to a planar work surface. The apparatus includes a base member positioned above a work surface. A four-bar linkage assembly couples a segment coupling assembly to the base member. The four-bar linkage assembly includes first and second elongated bar assemblies, each being pivotally coupled to the base member. The length of the second bar assembly is controllable within a predetermined range. A third elongated bar assembly is pivotally coupled at a first end to the segment coupling assembly, at a second end to the second bar assembly, and at an intermediate point to the first bar assembly. In addition, the apparatus includes a rotary actuator for selectively rotating the second bar assembly about a pivot axis extending through its point of connection to the base member. When the second bar assembly is in its retracted state, as that assembly is rotated by the rotary actuator, the segment coupling assembly travels along a substantially straight path substantially parallel and adjacent to the reference axis. Furthermore, when the second bar assembly is in its extended state, as the second bar assembly is rotated by the actuator, the coupling member travels in a non-straight path.

10 Claims, 10 Drawing Sheets

LIMP MATERIAL SEGMENT TRANSPORT APPARATUS FOR SEWING MACHINES

REFERENCE TO RELATED APPLICATION

The subject matter of this application is related to the subject matter of U.S. patent application Ser. No. 07/523,726 (CSL-174A), entitled "Limp Material Segment Coupler" filed even date herewith.

BACKGROUND OF THE INVENTION

This invention relates to the transportation of limp material segments, such as fabric. In particular, the invention relates to an apparatus for transporting limp material segments along a work surface.

Conventional techniques for transporting limp material segments along a work surface to a workstation often utilize manual labor. In the context of the textile industry, garment assembly personnel may manually feed the fabric workpiece or workpieces along a work surface to the sewing head of a sewing machine. Although many aspects of the textile industry benefit from automation, in practice transportation of fabric workpieces for assembly at a sewing machine largely remains dependent upon manual labor.

A primary shortcoming of the use of manually controlled workpiece transport is that the technique is enormously labor intensive; that is to say, a large portion of the cost to manufacture a product from limp material is attributable to labor. To reduce cost, techniques focusing on automation of transporting a limp material segment is desirable.

There are several known techniques for precisely controlling the position of the workpiece in the near-field region of the sewing head, see, for example, U.S. Pat. No. 4,719,864. Feed dog assemblies have also been used for this function. Those controllers however are generally so limited in their range of operation that other techniques are required to feed the workpiece to the effective range of the near-field controllers.

There are also known techniques for automatically (e.g. under the control of a programmed computer) driving endless belts to transport limp material workpieces over relatively large distances to workstations, see, for example, U.S. Pat. Nos. 4,457,243, 4,512,269, 4,032,046 and 4,607,584.

However, the endless belt techniques, which are particularly effective for control of gross motion control of workpieces are limited in their applicability to relatively short range motions necessary, for example, to present fabric to the near-field controller of an automated sewing machine. Therefore, there exists a need for improved systems for controlling the transport of limp material segments, particularly for application where linear feed control is needed to drive a workpiece to a position within the range of a near-field controller for a seam joining assembly.

SUMMARY OF THE INVENTION

The present invention is an apparatus for transporting a limp material segment, for example, cloth, along a reference axis parallel to a planar work surface.

The apparatus includes a base member positioned above a work surface. A four-bar linkage assembly couples a segment coupling assembly to the base member. The four-bar linkage assembly includes a first elongated bar assembly having a length L1 and being pivotally coupled to a first point P1 on the base member. A second elongated bar assembly, extending along a link axis and having a length L2, is pivotally coupled at a first end to a second point P2 on the base member, where the first point P1 is spaced apart from the second point P2. The length L2 of the second bar assembly is controllable along the link axis in a range L2-1 to L2-2, where L2-1 is less than L2-2.

A third elongated bar assembly, having length L3, is pivotally coupled at a first end to the segment coupling assembly (wherein its coupler pivot axis is substantially parallel to the work surface and substantially perpendicular to the reference axis), pivotally coupled at a second end to the second end of the second bar assembly and pivotally coupled to the first bar assembly at an intermediate point P3 between the first and second ends. The pivot axes for all of the above-described pivoting couplings are mutually parallel and are parallel to the work surface.

In addition, the apparatus includes an actuator for selectively rotating the second bar assembly about a pivot axis extending through point P2 between a first angle A1 and a second angle A2.

The values of L1, L2, and L3, and P1, P2, and P3, and A1 and A2 are such that as the second bar assembly is rotated by the actuator between angle A1 and angle A2, the segment coupling assembly travels along a substantially straight path substantially parallel and adjacent to the reference axis when second bar assembly is L2-1. Furthermore, when second bar assembly is L2-2 and is rotated by the actuator between angle A2 and angle A1, the coupling member travels in a non-straight path.

In various forms of the invention, the first and third bar assemblies may each be single element bars or, alternatively may each be a parallelogram link assembly. With the latter configuration, the angular orientation of the segment coupling assembly may readily be maintained fixed throughout its range of motion. Thus, a planar surface on the bottom of the segment coupling assembly may be maintained substantially parallel to the work surface particularly when the length of the second segment bar assembly is substantially equal to L2-1.

In another form of the invention, the apparatus for transporting a limp material segment is incorporated into a textile assembly apparatus, for example, a seam joining apparatus including needle and bobbin assemblies at a seam joining station on the work surface, and a feed dog assembly including means for driving a limp material segment overlying the feed dog assembly along a sewing axis on the work surface. Preferably, the sewing axis is angularly offset from the reference axis along which the segment coupling assembly traverses.

In one form of the invention, the segment coupling assembly may include a rigid drive member which is pivotally coupled to the third bar assembly about the coupler pivot axis. In this form, the segment coupling assembly further includes a segment coupler having a substantially planar lower surface. The lower surface is adapted to frictionally engage a limp material segment. A spring coupler couples the segment coupler to the drive member. The spring coupler includes at least one bent sheet spring. Each bent sheet spring includes a resilient sheet extending from a first end to a second end along at least one spring axis and is bent along at least one axis substantially perpendicular to the associated spring axis, wherein each of the springs is coupled at the inner end to the drive member and at the outer end to the segment coupler. The spring axes of each of the springs are substantially parallel to the planar surface of the segment coupler.

In single spring embodiments, for example, a single annular bent spring may couple the drive member to a peripheral ring-like segment coupler. In two spring embodiments, a pair of springs may couple opposing ends of the drive member to a peripheral ring-like segment coupler, where the two springs extend along a common spring axis. A second pair of similar, but ninety degree offset, springs may be used to form a four spring configuration. The three spring configuration may be established with three springs that are mutually offset by sixty degrees. Other configurations may also be used.

BRIEF DESCRIPTION OF THE DRAWINGS

The foregoing and other objects of this invention, the various features thereof, as well as the invention itself, may be more fully understood from the following description, when read together with the accompanying drawings in which.

DESCRIPTION OF THE PREFERRED EMBODIMENT

Figure 1A:
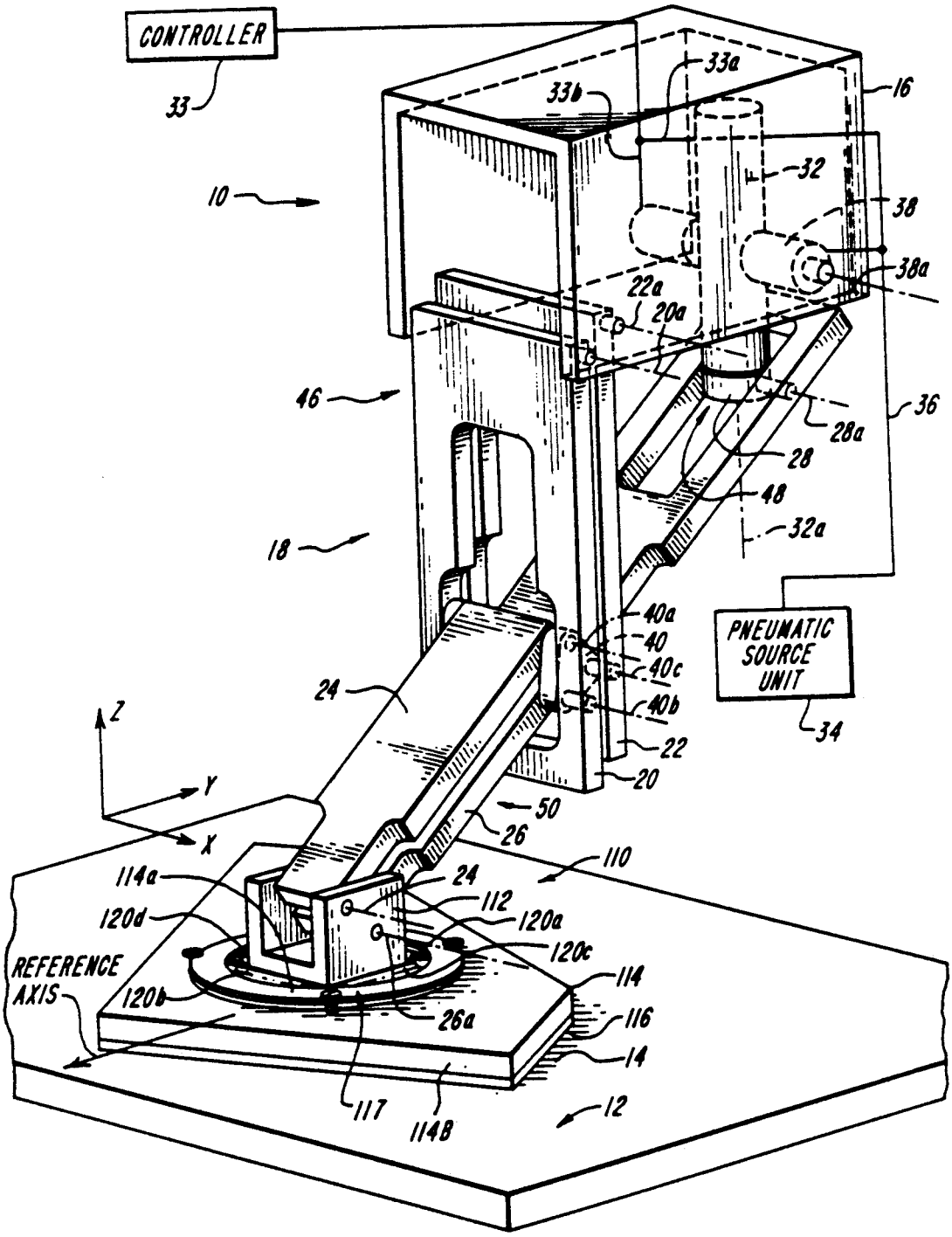
FIG. 1A illustrates an exemplary embodiment of a limp material segment transport apparatus in accordance with the present invention.
Figure 1B:
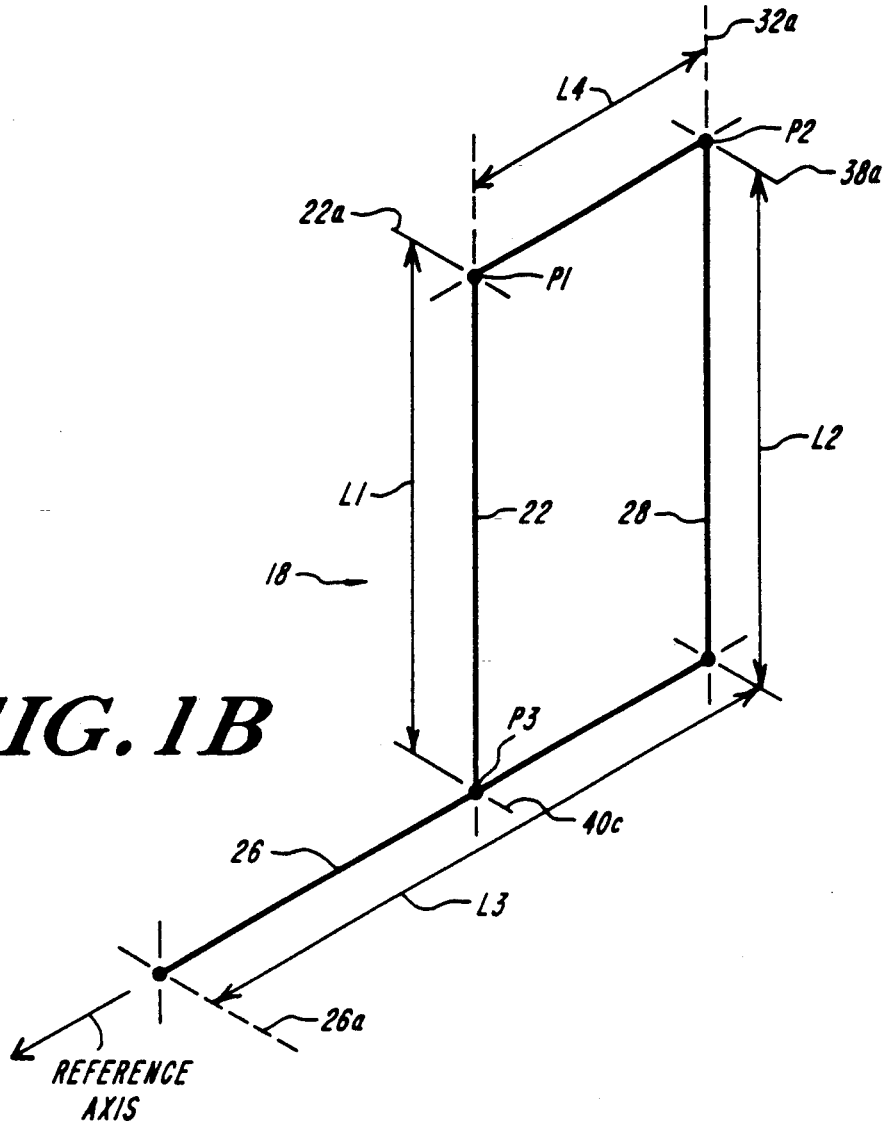
FIG. 1B illustrates a schematic representation of the embodiment of FIG. 1A.

FIGS. 1A and 1B show an exemplary limp material segment transport apparatus 10 in accordance with the present invention and a reference XYZ coordinate system. Apparatus 10 is shown with respect to a work platform 12 having a substantially planar upper surface 14 which is substantially parallel to the XY plane defined by the reference coordinate system. A base member 16 is fixedly positioned by a support assembly (not shown) above the work surface 14.

Apparatus 10 includes a segment coupling assembly 110 coupled by a four bar link assembly 18 to the base member 16, a pneumatic actuating extender assembly 32, a pneumatic actuating angular rotation assembly 38 (adapted to pivotally couple extender assembly 32 about pivotal coupling axis **38*a*), a pneumatic source unit 34 (which is connected via line 36 to extender assembly 32 and angular rotation assembly 38), and a controller 33 (which is electrically connected to extender assembly 32 and angular rotation assembly 38 via line 33*a* and 33*b*, respectively). The extender assembly 32, angular rotation assembly 38, four bar linkage assembly 18 and segment coupling assembly 110 are all coupled, directly or indirectly, to base member 16**.

Segment coupling assembly 110 is comprised of a rigid drive member 112, a spring coupler assembly 117, and a segment coupler 114 having a substantially planar lower surface 116 for frictionally engaging a limp material segment. In the embodiment of FIG. 1A, the segment coupler 114 includes a fastening ring 114A affixed to a block 114B.

The four-bar linkage assembly 18 includes a first bar assembly 46, a second bar assembly 48, and a third bar assembly 50, and a fourth bar assembly (effectively provided by the sidewalls of base member 16), and associated couplers for the respective bar assemblies. In the illustrative embodiment, first bar assembly 46 includes link member 20 and link member 22. Second bar assembly 48 includes variable length link member 28. Third bar assembly 50 includes link member 24 and link member 26.

A first end of link member 20 is pivotally coupled to support member 16 about a pivotal coupling axis **20*a* extending in the X-direction. Similarly, a first end of link member 22 is pivotally coupled to support member 16 about a pivotal coupling axis 22*a* extending in the X-direction. Link member coupling assembly 40 is pivotally coupled (about an x-directed pivotal coupling axis 40*a*) to a first end of link member 24. Assembly 40 also is pivotally coupled (about an x-directed pivotal coupling axis 40*b*) to the second end of link member 20. Assembly 40 also is pivotally coupled (about an x-directed pivotal coupling axis 40*c*) to an intermediate point on link member 26 and to the second end of link member 22. The other end of link member 24 is pivotally coupled to segment coupling assembly 110 about X-directed pivotal coupling axis 24*a*. Similarly, the other end of link member 26 is pivotally coupled to segment coupling assembly 110 about x-directed pivotal coupling axis 26*a***.

Figure 2:
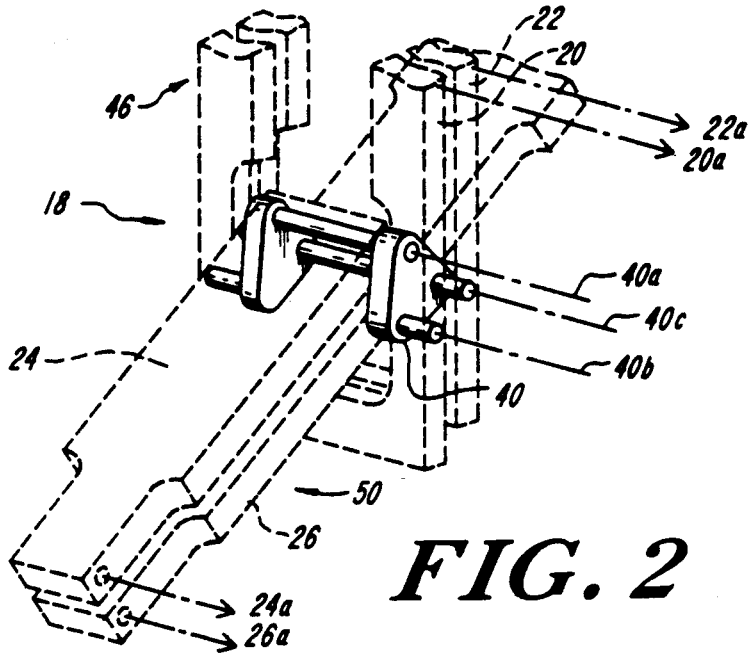
FIG. 2 illustrates in a perspective view the link coupling assembly for the parallelogram linkage assembly of the transport apparatus of FIG. 1.

FIG. 2 illustrates, in exploded view form four bar linkage assembly 18 including coupling assembly 40, and the link members 20, 22, 24, and 26, of assembly 10 shown in FIG. 1. In the present embodiment, link member 20 and link member 22 configured in a substantially parallel relationship, and in addition form two sides of a parallelogram having vertices defined by the pivotal coupling axes **20*a*, 22*a*, 40*b*, and 40*c*. Similarly, link member 24 and link member 26 are configured in a substantially parallel relationship, and in addition form two sides of a parallelogram with vertices defined by the pivotal coupling axes 24*a*, 26*a*, 40*a*, and 40*c*. FIG. 2 further illustrates link member coupling assembly 40 of assembly 10 shown in FIG. 1. Link member coupling assembly 40 is utilized to constrain link member 20, link member 22, link member 24, and link member 26** respectively, in the above mentioned parallelogram configurations.

Link member 28 is reciprocally coupled to extender assembly 32 whereby the length of link member 28 may be extended or retracted along axis **32*a* by actuating or deactivating extender assembly 32 respectively. Controller 33, via line 33*b*, controls the state of extender assembly 32**.

When extender assembly 32 is in a deactivated state, link member 28 is in a retracted position, as shown in FIG. 1A. In the retracted position, link member 28 permits segment coupling assembly 110 to travel along a substantially straight path, at a nominal height above work surface 14, and substantially parallel to the reference axis.

In contrast, when extender assembly 32 is in an activated state, link member 28 is in an extended position. In the extended position, link member 28 causes segment coupling assembly 110 to pivot about pivotal coupling axis 40c in rising above its nominal height with respect to work surface 14.

Base member 16, link member 22, link member 28, and link member 26 are configured in an arrangement having appropriate proportions to utilize a Hoecken's straight-line motion. That is to say, with appropriate link member proportions, lower surface 116 of segment coupling assembly 110 remains at a constant height above work platform 12 during transportation of a limp material along work platform 12.

Prior to the start of operation, the actuator assembly 38 initially controls axis 32a to be offset approximately 135 degrees counterclockwise (viewed from the +X axis) from the position shown in FIG. 1A. This angle is referred to below as angle A1. Thus, in operation, the drive member 112 is in a raised position to allow for placement of a limp material workpiece directly below lower surface 116. Once the material is in place, the drive member 112 of segment coupling assembly 110 then is established at a nominal level above upper surface 14 of work platform 12 such that lower surface 116 is in vertically compliant contact with a limp material which is to be moved in the −Y direction along work surface 14. With extender assembly 32 in a deactivated state (link member 28 in a retracted position), controller 33 activates angular rotational assembly 38 causing assembly 38 to rotate approximately 135 degrees about axis 38a in clockwise direction. In response, segment coupling assembly 110 is forced in the −Y direction to the position shown in FIG. 1A. The link members rotate about their respective pivotal coupling points detailed above thereby changing angles of the previously described parallelograms; however, segment coupling assembly 110 remains at a constant level above work platform 12. The linear distance traversed by segment coupling assembly 110 is directly proportional to the aggregate rotation of angular rotation assembly 38.

After angular rotational assembly 38 rotates in the clockwise direction for approximately 135 degrees, controller 33 activates extender assembly 32 thus extending link member 28 and consequently causing segment coupling assembly 110 to rise. Pivotal coupling axis 40c is utilized as a fulcrum in a "see-saw" type configuration; that is to say the extension of link member 28 causes segment coupling assembly 110 to pivot about pivotal coupling axis 40c in rising above its nominal height with respect to work platform 12.

With link member 28 in the extended position, controller 33 commands angular rotational assembly 38 to rotate 135 degrees in counterclockwise direction. Then the actuator 32 is activated to fully retract link member 28. Controller 33 then deactivates extender assembly 32 thereby retracting the link member 28 to its normal position which corresponds to returning segment coupling assembly 110 to the original nominal height above work platform 12. The segment coupling assembly 110 thus is returned to its original position.

Figure 3A:
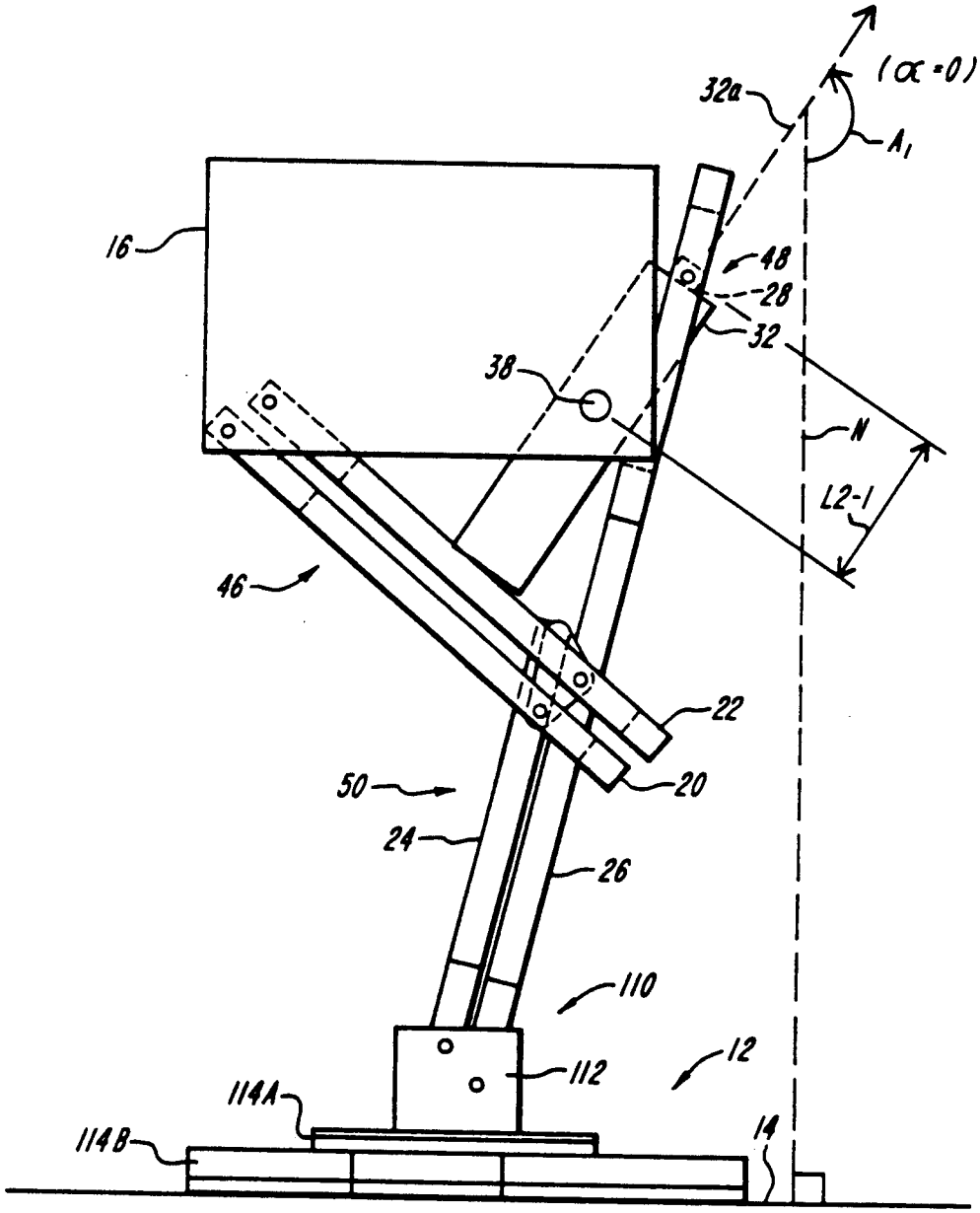
FIGS. 3A–3D illustrate side views of the transport apparatus of FIG. 1 at various positions within its range of motion.

FIGS. 3A, 3B, 3C, and 3D depict the configuration of segment coupling assembly 110, angular rotation assembly 38, extender assembly 32, and the link members in four state of the periodic motion of apparatus 10. FIG. 3A illustrates apparatus 10 in its "initial" state wherein angular rotation assembly 38 is at position with axis 32a at its nominal position $\alpha=0$ degrees, (i.e. A1 or 135° counterclockwise from the normal (N) to the surface 14) and extender assembly 32 is in a deactivated state (with link member 28 fully retracted). The "initial" state follows placement of the limp material beneath surface 116 during which link member 28 is extended.

Figure 3B:
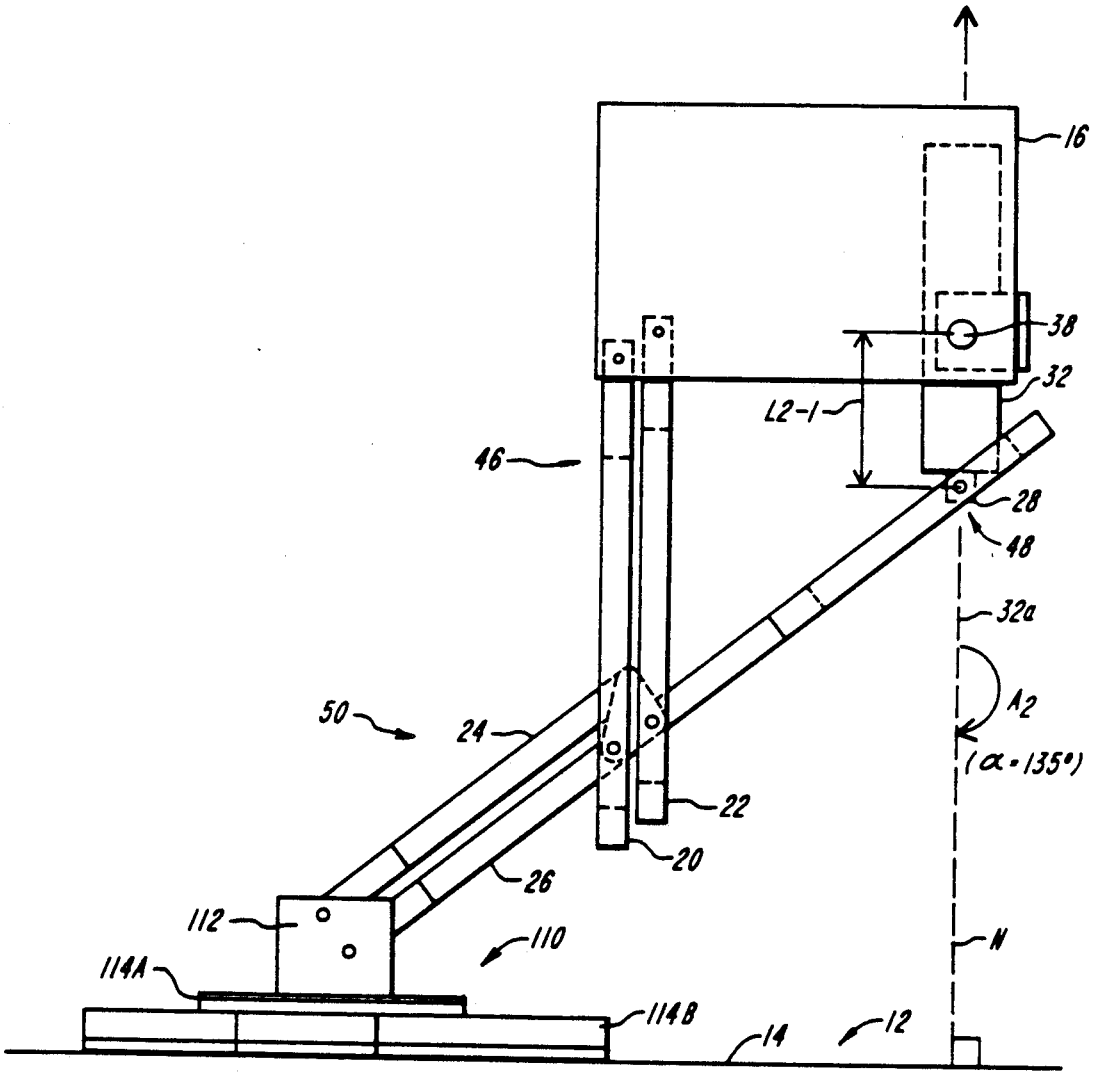

FIG. 3B illustrates apparatus 10 after segment coupling assembly 110 completed linear travel wherein angular rotation assembly 38 is approximately at position $\alpha=135$ degrees (i.e. A2 or 0° from the normal (N) to the surface 14) and extender assembly 32 remains in a deactivated state.

Figure 3C:
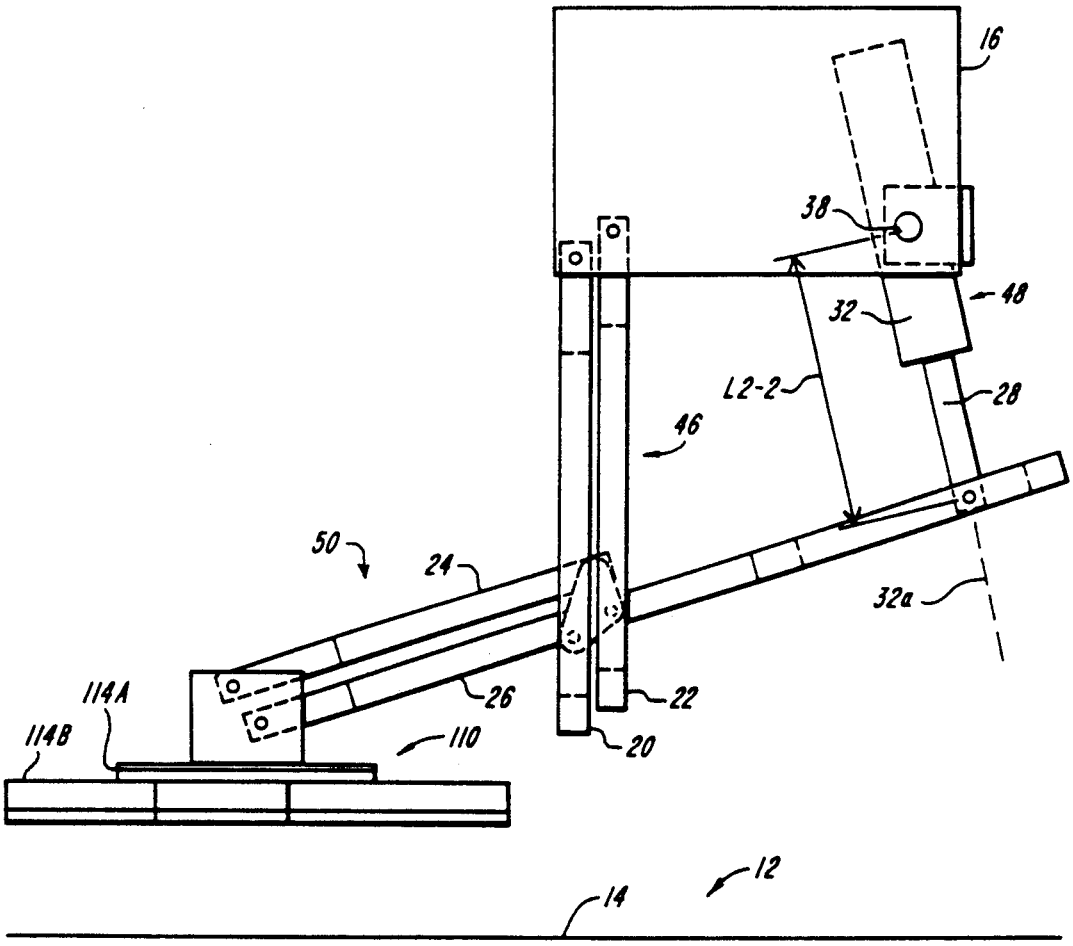

FIG. 3C illustrates apparatus 10 after extender assembly 32 is activated thereby extending link member 28. As detailed above, in response segment coupling assembly 110 lifts above its nominal position above work platform 12.

Figure 3D:
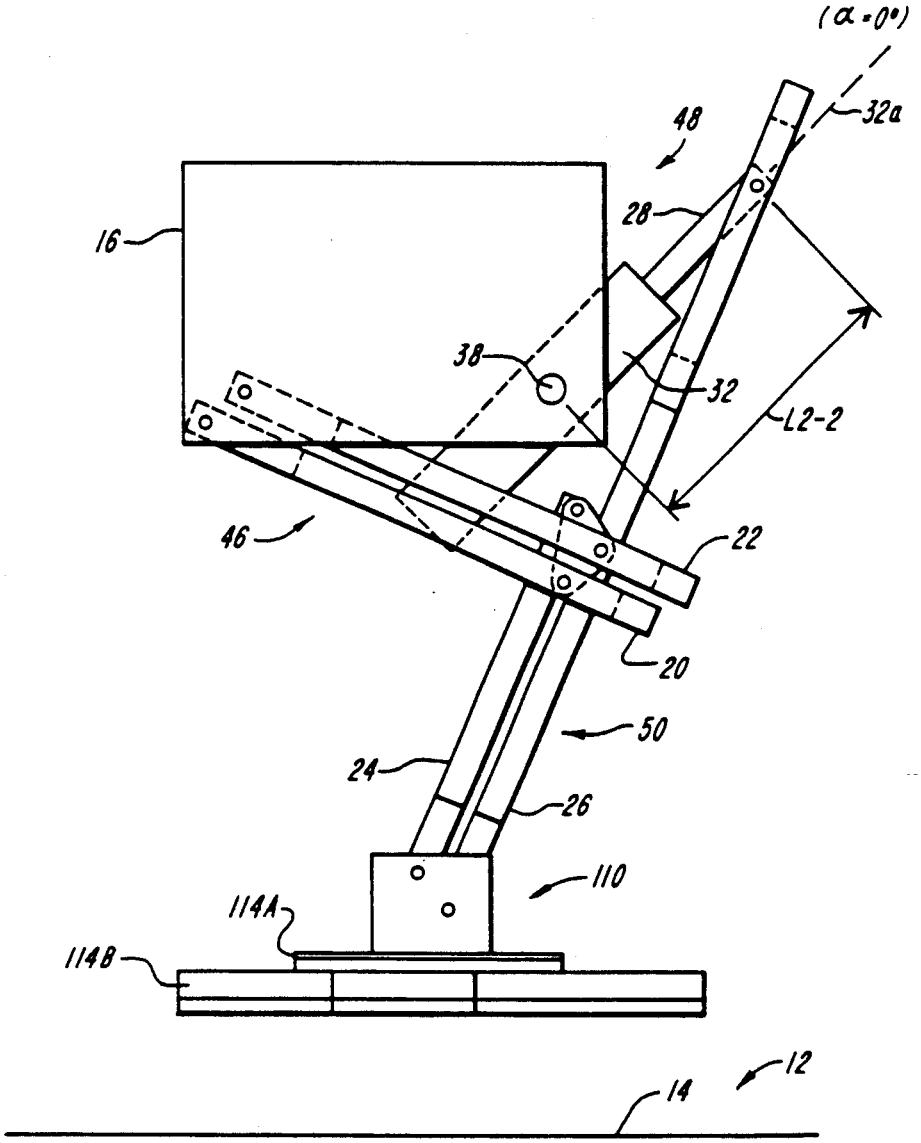

FIG. 3D illustrates apparatus 10 after angular rotation assembly 38 returns to the position of $\alpha=0$ degrees. In addition, extender assembly 32 remains in an activated state.

Figure 4:
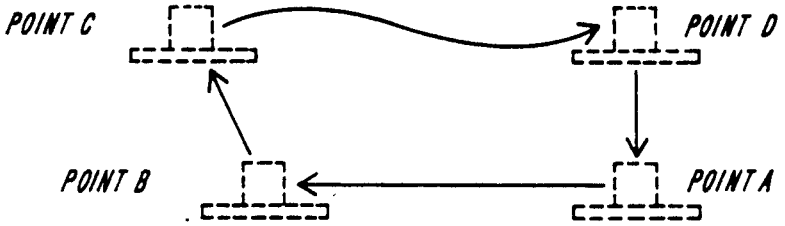
FIG. 4 illustrates the range of motion of the segment coupling assembly of the embodiment of FIG. 1.

FIG. 4 illustrates the cyclic motion of apparatus 10 with respect to the path traced by segment coupling assembly 110. Segment coupling assembly 110 traces a linear path horizontal to work platform 12 from Point A to Point B during which lower surface 116 of segment coupling assembly 11 is engaged with a limp material. The linear distance traversed by segment coupling assembly 110 from Point A to Point B is directly proportional to the aggregate rotation of angular rotation assembly 38 and the link member proportions. At Point B, extender assembly 32 is actuated causing segment coupling assembly 110 to lift above work platform 12 and traverse to point C. Angular rotation assembly 38 then returns to the $\alpha=0$ degrees whereby segment coupling assembly 110 traces a path from Point C to Point D. At Point D extender assembly is deactivated and thus segment coupling assembly 110 returns to its original height above work platform 12.

Although the system operation description detailed a clockwise periodic motion, apparatus 10 may be operated in a counter-clockwise periodic motion. This translates into a +Y directional movement of a limp material along work platform 12. In addition, the aggregate angle traversed by angular rotation assembly 38 is user-selectable to satisfy the system constraints. For example, a shorter linear travel of segment coupling assembly 110 may be achieved when the user selects an aggregate angle less than 135 degrees. Similarly, a longer linear travel of segment coupling assembly 110 may be achieved via an aggregate angle greater than 135 degrees (e.g., up to 180°).

As mentioned above, and as illustrated in FIG. 1B, link member 22 (link L1), link member 28 (link L2), link member 26 (link L3), and base member 16 (link L4) are configured in a configuration having appropriate proportions to utilize a Hoecken's straight-line motion. The appropriate link proportions that provide linear horizontal travel of segment coupling assembly 110 are defined below:

| | |
|---|---|
| link L1 | 2.5 |
| link L2-1 (L2 extended) | 2.0 |
| link L2-2 (L2 retracted) | 1.0 |

-continued

| | |
|---|---|
| link L3 | 5.0 |
| link L4 | 2.0 |

In addition, pivotal coupling axes 22a and 38a are vertically proportionally displaced from each other substantially by 0.0 and horizontally proportionally displaced from each other substantially by 2.0; and pivotal coupling axis 40c is proportionally displaced from the distal end of link member 26 substantially by 2.5 along longitudinal axis of that link member. Utilizing the aforementioned link member proportions, a linear proportional travel of segment coupling assembly 110 of 3.0 is realized for 135° rotation of angular rotation assembly 38; a linear proportional travel of 4.0 may be achieved with a full 180° rotation of assembly 38.

In one embodiment, link Ll, link L2-1 (L2 extended), link L2-2 (L2 retracted), link L3, and link L4 are substantially equal to 2.5 inches, 2.0 inches, 1.0 inches, 5.0 inches, and 2.0 inches, respectively. In addition, pivotal coupling axes 22a and 38a are vertically displaced from each other substantially by 0.0 inches and horizontally displaced from each other substantially by 2.0 inches; and pivotal coupling axis 40c is displaced from the distal end of link member 26 substantially by 2.5 inches along link member axis. Other dimensions consistent with the proportional dimensions given above may be used depending upon the desired final apparatus size.

Figure 5:
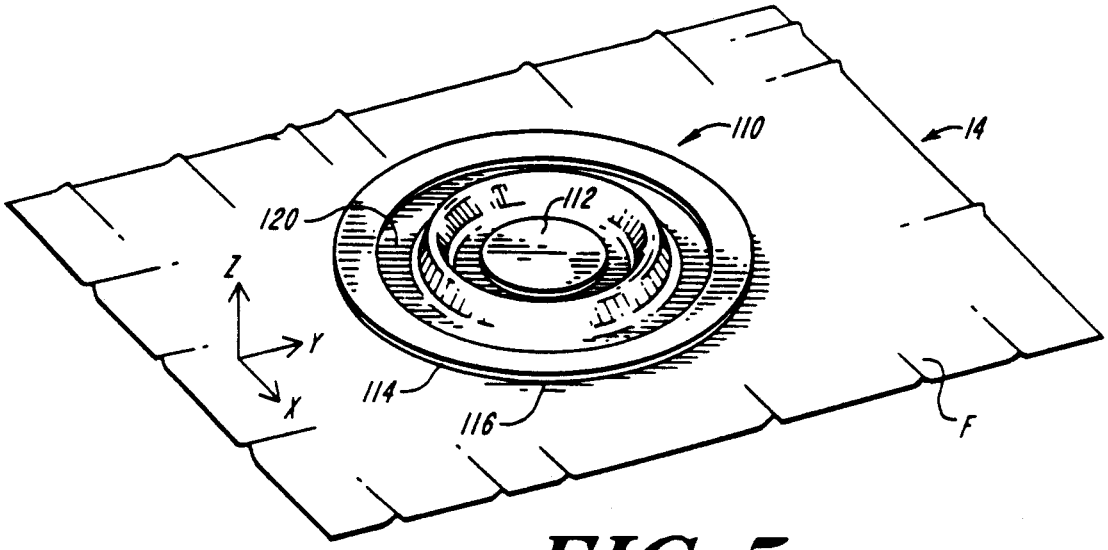
FIG. 5 illustrates in a perspective view one embodiment of the segment coupling assembly of the transport apparatus of FIG. 1.

FIG. 5 shows a limp material segment coupling assembly 110 disposed over a limp fabric workpiece F on the planar top surface 14 of work platform 12. Assembly 110 includes a rigid drive member 112, an annular segment coupler 114 having a substantially planar lower surface 116 which is adapted to frictionally engage the limp material segment F, and the spring coupling assembly 117.

It should be noted, the dimensions of segment coupler 114 may be tailored to suit the system and user needs. That is to say, the user, or system, may require segment coupler 114 to make contact with a relatively large portion of the limp material to be positioned on work platform 12. FIG. 1 depicts a segment coupler 114 including a fastening ring 114A affixed to a block 114B. Block 114B has a lower surface 116 that has a greater limp material contact area than the corresponding lower surface 116 of the segment coupler depicted in FIG. 5.

The spring coupling assembly 117 is comprised of a sheet spring 120 which is an annular resilient sheet extending from an inner peripheral edge to an outer peripheral edge. Sheet spring 120 is coupled at its inner peripheral edge to drive member 112 and at its outer peripheral edge to segment coupler 114. The sheet spring 120 has an annular region 121 which is bent about a closed circular axis. For this annular spring embodiment, spring axes are considered to extend radially outward from the center of the drive member 12. The spring axes are substantially parallel to the lower planar surface 116 of segment coupler 114.

In operation, limp material segment coupling assembly 110 substantially resists rotational and/or undesired lateral motion when engaged with and, during the transportation of, a limp material segment along work platform 12. Assembly 110 is utilized to frictionally couple a limp material workpiece and in response to an applied force to drive member 112 traverse a path substantially coherent with the direction of the horizontal component of the applied force.

In particular, limp material segment coupling assembly 110 is configured such that it is substantially resistant to torsional and/or lateral motion in the X-Y plane. That is to say, when a force is applied to drive member 112, wherein the applied force has both vertical and horizontal components, assembly 110 is resistant to torsional motion with respect to both the direction of the horizontal component of the applied force and the substantially planar surface 14 of work platform 12. However, assembly 110, in response to the applied force traverses a substantially coherent path with respect to the direction of the horizontal component of the applied force. Coupler 114 of assembly 110 is relatively vertically compliant to accommodate for variability in thickness (such as caused by cross-seams) in limp material F. Moreover, coupler 114 is substantially resistant to linear or rotational motion (relative to drive member 112) in the X and Y direction.

Figure 6:
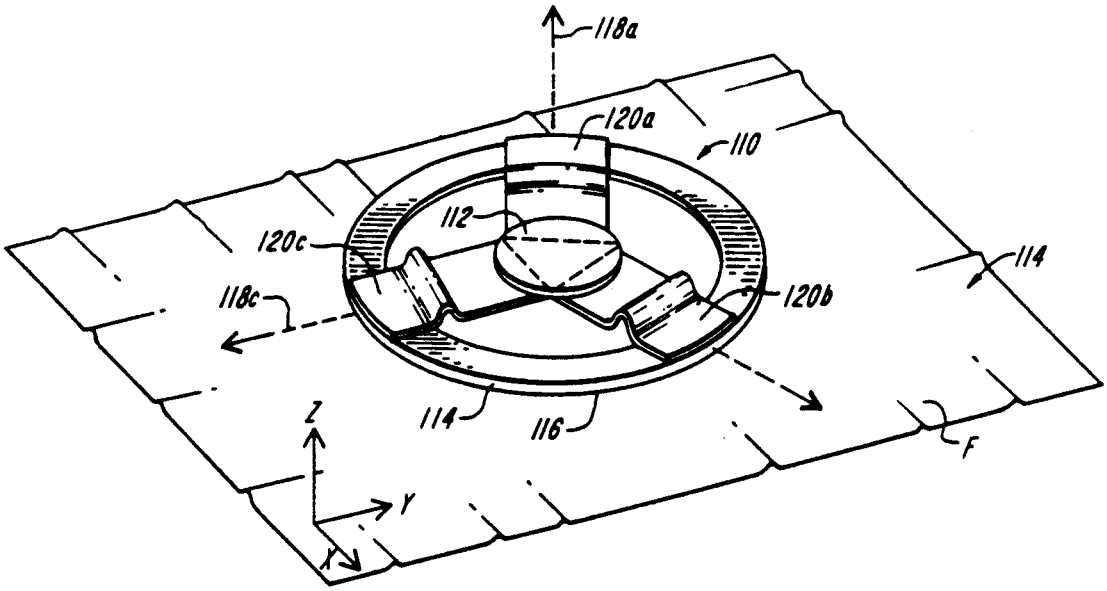
FIG. 6 illustrates in a perspective view another embodiment of the segment coupling assembly.

FIG. 6 shows the spring coupling assembly 117 for an embodiment of a limp material segment coupling assembly 110 in accordance with the present invention. In the illustrative embodiment, spring coupling assembly 117 includes three bent sheet springs 120a, 120b and 120c.

Sheet springs 120a, 120b and 120c are each comprised of a resilient sheet extending from a first end to a second end along spring axes 118a, 118b and 118c, respectively. Sheet springs 120a, 120b and 120c are coupled at the inner end to drive member 112 and at the outer end to segment coupler 114 wherein the sheet springs are bent along axes perpendicular to spring axes 118a, 118b and 118c, respectively. In the illustrative embodiment, spring axes 118a, 118b and 118c are substantially parallel to planar surface 116 of segment coupler 114, and in addition are in an equiangular configuration, although differing angular dispersions may be used in other embodiments.

Figure 7:
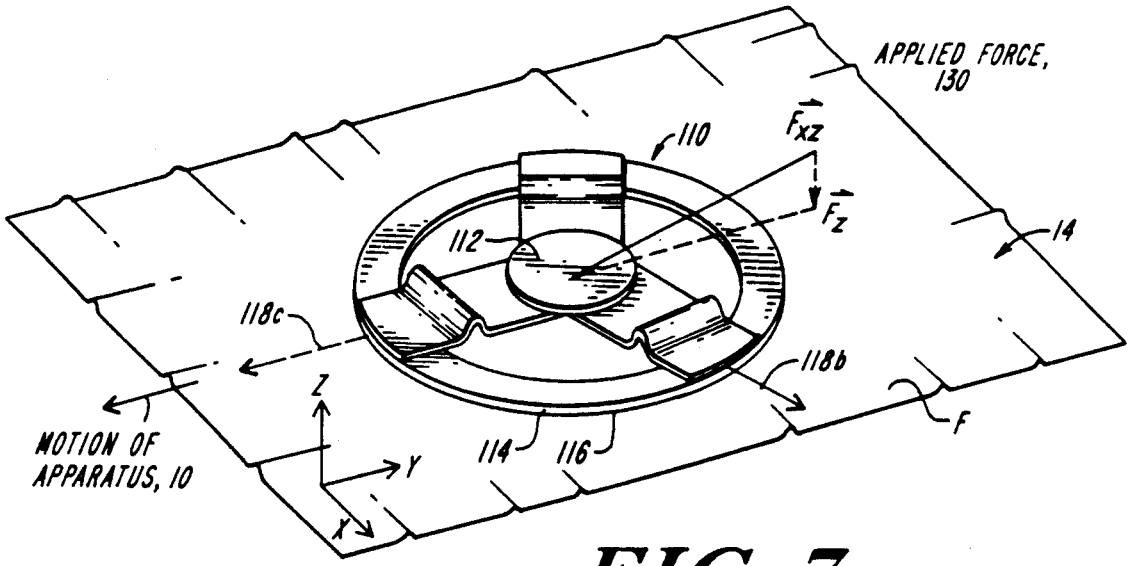
FIG. 7 illustrates in a perspective view the segment coupling assembly of FIG. 6 under an applied force.

FIG. 7 illustrates the reaction and motion of the assembly 110 of FIG. 6 due to an applied force $F_{xz}$ denoted by the force vector. As described above, sheet springs 120a, 120b, and 120c are configured to resist the torsional motion and/or the undesired lateral movement resulting from applied force 130. Segment coupler 114 traverses a path substantially coherent with respect to the direction of the horizontal component of applied force 130. In the illustrated embodiment, applied force 130 includes a vertical component ($F_z$) and a horizontal component ($F_x$). In response to applied force 130, limp material segment coupling assembly 110 traverses a direction substantially coherent with the direction of horizontal component ($F_x$). Note, when coupling assembly 110 is engaged with a limp material segment, sheet springs 120a, 120b, and 120c permit segment coupler 114 to tilt with respect to the planar work platform 12. This permits the assembly to accomodate for lumps in the material such as those due to cross-seams.

Figure 8:
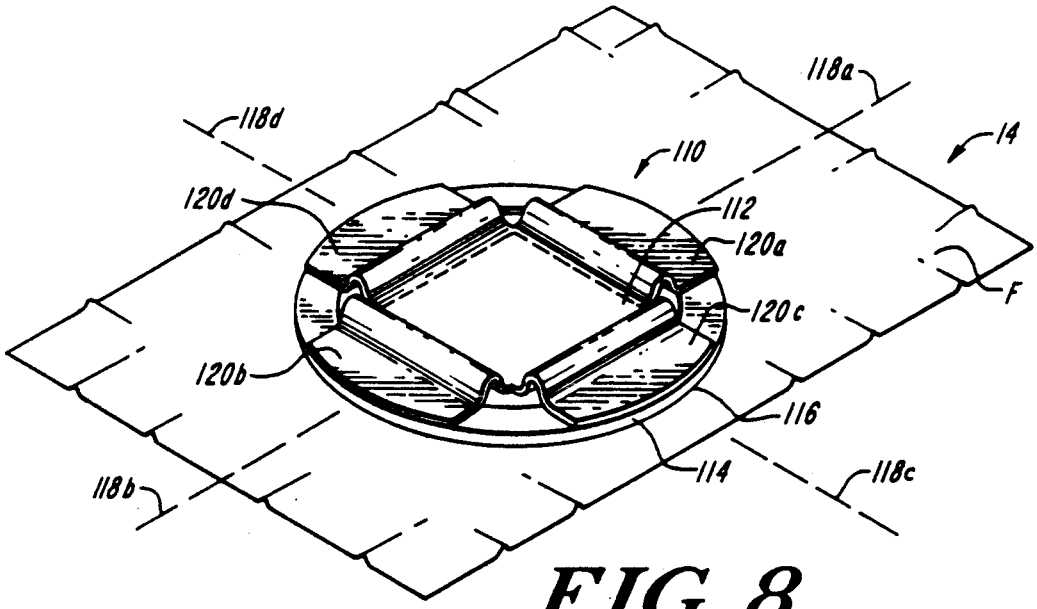
FIG. 8 illustrates in a perspective view another embodiment of the spring coupler assembly.

FIG. 8 shows the spring coupling assembly for an alternative embodiment of a limp material segment coupling assembly 110 in accordance with the present invention. In the illustrative embodiment, spring coupling assembly 117 includes four bent sheet springs 120a, 120b, 120c and 120d extending from an integral central region. A first pair of sheet springs 120a and 120b are comprised of a resilient sheet extending along spring axes 118a and 118b, respectively. A second pair of sheet springs 120c and 120d are also comprised of a resilient sheet extending along spring axes 118c and 118d, respectively.

As in the previously described embodiment, sheet springs 120a, 120b, 120c and 120d are coupled at the inner end at the central region to drive member 112 and at the outer end to segment coupler 114 wherein the sheet springs are bent along an axis perpendicular to spring axes 118a, 118b, 118c and 118d, respectively. Spring axes 118a, 118b, 118c and 118d are substantially parallel to planar surface 116 of segment coupler 114. In addition, spring axes 118a and 118b of first pair of sheet springs (120a and 120b) are substantially perpendicular to spring axes 118c and 118d of the second pair of sheet springs (120c and 120d); and, sheet springs 120a, 120b, 120c and 120d are in an equi-angular configuration.

Figure 9:
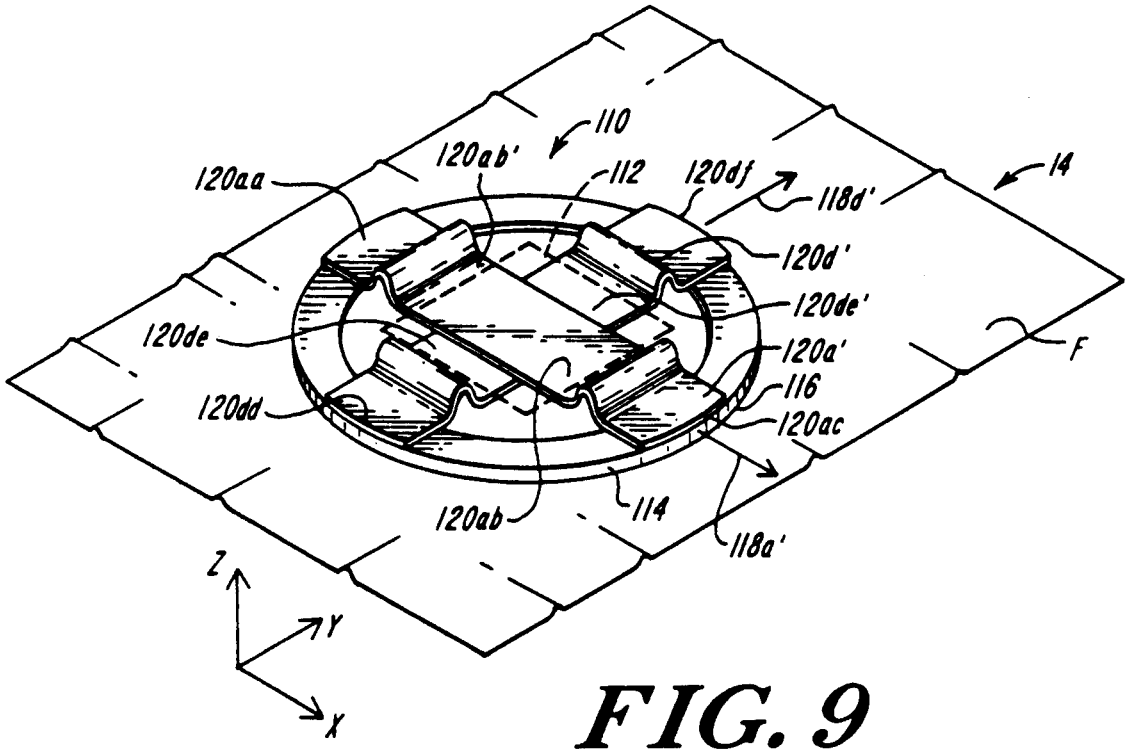
FIG. 9 illustrates in a perspective view another embodiment of the spring coupler assembly.

Illustrated in FIG. 9 is an alternative form of the embodiment illustrated in FIG. 8, specifically an alternate form of spring coupling assembly 117. Sheet springs 120a and 120b may be comprised of a single resilient sheet 120a', extending along a single spring axis 118a', coupled at first distal end 120aa to segment coupler 114, at intermediate point 120ab and 120ab' to rigid drive member 112, and at second distal end 120ac to segment coupler 114. Similarly, sheet spring 120c and 120d may be comprised of a single resilient sheet 120d', extending along a single spring axis 118d', coupled at first distal end 120dd to segment coupler 114, at an intermediate point 120de and 120de' to rigid drive member 112, and at second distal end 120df to segment coupler 114. In addition, spring axes 118a' and 118d' are substantially perpendicular.

Figure 10:
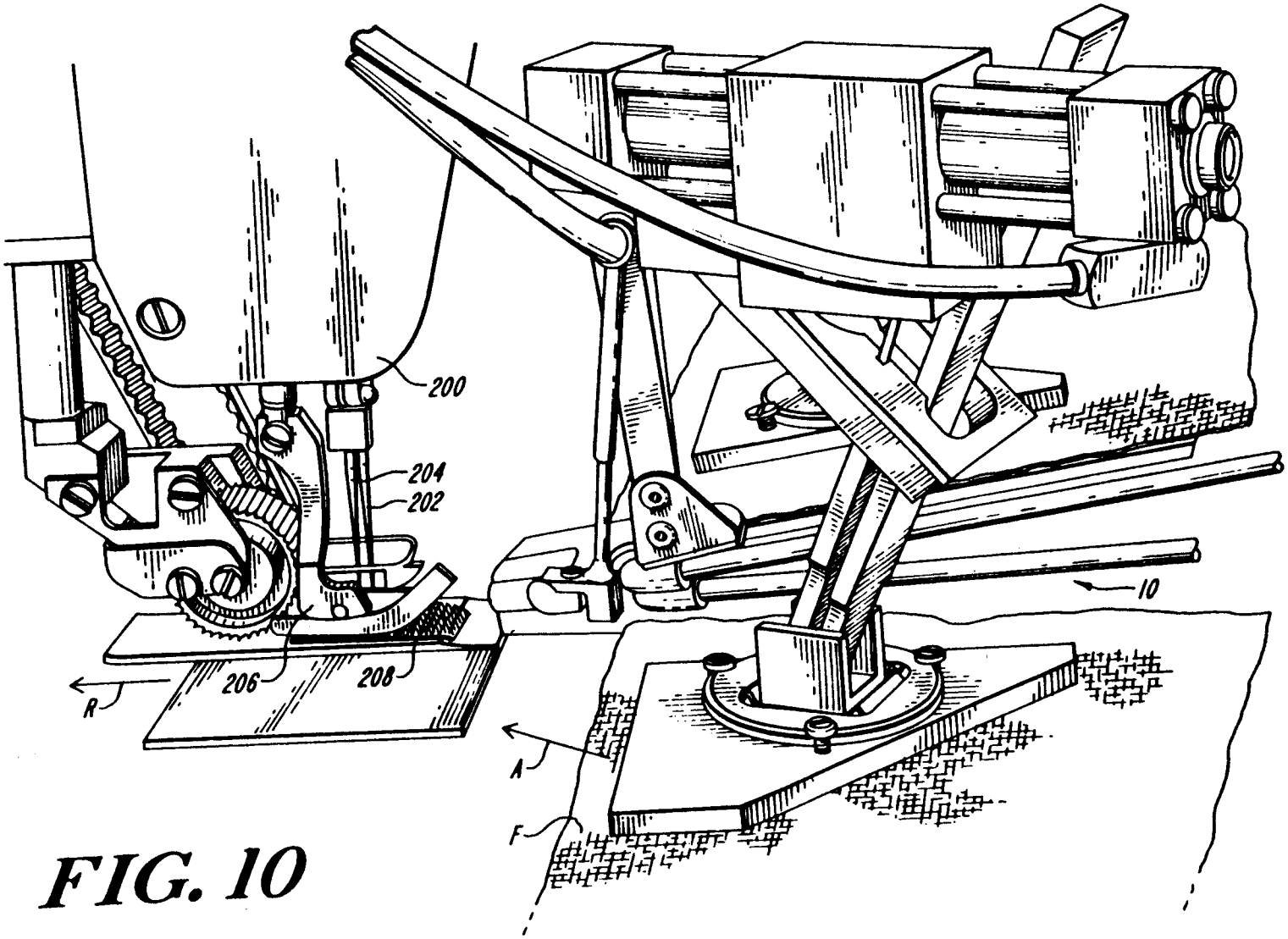
FIG. 10 shows a sewing machine together with an exemplary limp material transport apparatus of the invention.

FIG. 10 shows portions of a sewing machine 200, including a pair of needles 202 and 204, presser foot 206, and feed dogs 208, disposed over the planar work surface 14. A limp material transport apparatus 10 is also positioned to drive a limp material segment F along a feed axis A toward the feed dogs and needles. In this embodiment, the feed axis A is angularly offset from the reference (or sewing) axis R.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. Apparatus for transporting a material segment along a reference axis on a substantially planar work surface comprising:

A. a base member positioned above said work surface;

B. a segment coupling assembly;

C. a four-bar linkage means for coupling said segment coupling assembly to said base member; wherein said linkage means includes:

i. a first elongated bar assembly having length L1 and pivotally coupled at a first end thereof to a first point P1 on said base member, ii. a second elongated bar assembly having length L2 and extending along a link axis and an associated means for controlling said length L2 of said second bar assembly in a range L2-1 to L2-2, where L2-1 is less than L2-2, in the direction of said link axis, said second bar member being pivotally coupled at a first end thereof to a second point P2 on said base member, said first point P1 being spaced apart from said second point P2, iii. a third elongated bar assembly having length L3 and having a first end and a second end, said third bar assembly being pivotally coupled at said second end thereof to the second end of said second bar assembly, and being pivotally coupled at an intermediate point P3 between said first and second ends thereof, to the second end of said first bar assembly, iv. means for pivotally coupling said segment coupling assembly to said first end of said third bar assembly about a coupler axis substantially parallel to said work surface and substantially perpendicular to said reference axis, and v. an actuator including means for selectively rotating said second bar assembly about a pivot axis extending through said point P2 between a first angle A1 and a second angle A2 measured with respect to an axis normal to said work surface, wherein L1, L2, and L3, and P1, P2, and P3, and A1 and A2 are such that as said second bar assembly is rotated by said actuator between angle A1 and angle A2 with the length of said second bar assembly being L2-1, said segment coupling assembly travels along a substantially straight path substantially parallel and adjacent to said reference axis and as said second bar assembly is rotated by said actuator between angle A2 and angle A1 when the length of said second bar assembly is L2-2, said segment coupling assembly travels in a non-straight path.

2. An apparatus according to claim 1 wherein said segment coupling assembly further comprises means for resiliently biasing said segment against said work surface.

3. The apparatus according to claim 2 wherein said angles A1 and A2 are substantially equal to 0 degrees and 135 degrees, respectively, from the normal to said work surface and L1, L2-1, L2-2, and L3 are substantially in proportion to 2.5, 1.0, 2.0, and 5.0, respectively, and P1 and P2 are proportionally displaced from each other in the direction of said normal substantially by 0.0 and proportionally displaced from each other in the direction perpendicular to said normal substantially by 2.0, and P3 proportionally is displaced from said first end of said third bar assembly substantially by 2.5 in the direction of said link axis.

4. The apparatus according to claim 2 wherein said segment coupling assembly comprises:

A. a rigid drive member, said drive member being pivotally coupled to said third bar assembly out said coupler axis, B. a segment coupler including a substantially planar surface, said substantially planar surface having means for frictionally engaging said limp material segment, C. spring coupling means for coupling said segment coupler to said drive member, said spring coupling means including:

at least one bent sheet spring, each of said springs including a resilient sheet extending from an inner end to an outer end along at least one spring axis and being bent along an axis perpendicular to said spring axis, and each of said springs being coupled at an inner end to said drive member and at said outer end to said segment coupler with said spring axes of each of said springs being substantially parallel to said planar surface of said segment coupler.

5. Apparatus according to claim 4 wherein said spring coupling means comprises:

i. a first bent sheet spring, said spring including a resilient sheet extending along a first spring axis and being bent along axes perpendicular to said spring axis, and being coupled at a first distal end to said segment coupler, at an intermediate point to the rigid drive member, and at a second distal end to said segment coupler, and ii a second bent sheet spring, said spring including a resilient sheet extending along a second spring axis and being bent along axes perpendicular to said second spring axis, and being coupled at a first distal end to said segment coupler, at an intermediate point to said rigid drive member, and at a second distal end to said segment coupler, and wherein said spring axes of said first sheet spring are substantially perpendicular to the spring axes of said second sheet spring and each are substantially parallel to said planar surface of said segment coupler.

6. Apparatus according to claim 4 wherein said spring coupling means comprises:

three bent sheet springs, each of said springs including a resilient sheet extending from an inner end to an outer end along a spring axis and being bent along an axis perpendicular to said spring axis, and each of said springs being coupled at said inner end to said drive member and at said outer end to said segment coupler, wherein said spring axes are substantially equi-angularly dispersed about said drive member.

7. Apparatus according to claim 4 wherein said spring coupling means comprises:

i. a first pair of bent sheet springs each of said springs including a resilient sheet extending from a first end to a second end along a spring axis and being bent along an axis perpendicular to said spring axis, and each of said springs being coupled at one end to said drive member and at the other end to said segment coupler with the spring axes of each of said springs of said first pair being substantially parallel, and ii. a second pair of bent sheet springs, each of said springs including a resilient sheet extending from a first end to a second end along a spring axis and being bent along an axis perpendicular to said spring axis, and each of said springs being coupled at said inner end to said drive member and at said outer end to said segment coupler with the spring axes of each of said springs of said second pair being substantially parallel; and wherein said spring axes of said first pair are substantially perpendicular to the spring axes of said second pair and are substantially parallel to said planar surface of said segment coupler.

8. Apparatus according to claim 4 wherein said spring coupling means comprises:

a single annular bent spring, said spring including an annular resilient sheet extending radially from an inner end to an outer end along radially extending spring axes and being bent along axes perpendicular to said spring axes, said spring being coupled at said inner end to said drive member and at said outer end to said segment coupler.

9. The apparatus of claim 2 wherein said first and third bar assemblies each include parallelogram link assemblies whereby said planar surface of said segment coupler is substantially parallel to said work surface.

10. Apparatus according to claim 2 further comprising a seam joining apparatus including a needle assembly at a seam joining station on said work surface, and further including a feed dog assembly including means for driving a limp material segment overlying said feed dog assembly along a sewing axis on said work surface, wherein said sewing axis is angularly offset from said reference axis.

* * * * *